US006488893B1

(12) United States Patent
Elgarhy et al.

(10) Patent No.: US 6,488,893 B1
(45) Date of Patent: Dec. 3, 2002

(54) POLYAMIDE SUBSTRATE HAVING STAIN RESISTANCE, COMPOSITION AND METHOD

(75) Inventors: Yassin M. Elgarhy, Laval (CA); Karim Elgarhy, Laval (CA)

(73) Assignee: Trichromatic Carpet Inc., St-Eustache (CA)

( * ) Notice: Subject to any disclaimer, the term of this patent is extended or adjusted under 35 U.S.C. 154(b) by 0 days.

(21) Appl. No.: 09/410,082

(22) Filed: Oct. 1, 1999

(51) Int. Cl.[7] ..... B32B 27/02; B32B 27/04; B32B 27/08; B32B 27/12; B32B 27/30

(52) U.S. Cl. ..... 422/93; 8/495; 8/115.6; 8/115.56; 8/115.64; 422/92; 422/94; 422/86; 422/88; 422/168; 427/385.5; 427/389.9; 427/393.4; 428/96; 428/375; 428/378; 428/395; 428/477.4; 428/476.3; 524/157; 524/158; 524/171; 524/510; 524/512; 524/593; 524/594; 524/595; 524/596; 252/8.62

(58) Field of Search ..... 8/495, 115.6, 115.56, 8/115.64; 422/168, 92, 93, 94, 86, 88; 252/8.62; 427/385.5, 389.9, 393.4; 428/94, 375, 378, 395, 477.4, 476.3; 524/171, 157, 158, 510, 512, 593, 594, 595, 596

(56) References Cited

U.S. PATENT DOCUMENTS

| | | | | | |
|---|---|---|---|---|---|
| 4,822,373 | A | * | 4/1989 | Olson et al. | 8/115.6 |
| 4,833,009 | A | | 5/1989 | Marshall | 428/267 |
| 4,937,123 | A | * | 6/1990 | Chang et al. | 428/96 |
| 5,457,259 | A | | 10/1995 | Elgarhy et al. | 428/224 |
| 5,549,963 | A | * | 8/1996 | Elgarhy et al. | 428/224 |
| 5,672,674 | A | | 9/1997 | Walz et al. | 528/129 |
| 5,736,468 | A | | 4/1998 | Elgarhy | 442/93 |
| 5,756,407 | A | | 5/1998 | Elgarhy et al. | 442/168 |
| 6,395,655 | B1 | * | 5/2002 | Elgarhy | 442/93 |

FOREIGN PATENT DOCUMENTS

| | | |
|---|---|---|
| CA | 2050518 | 9/1991 |

* cited by examiner

*Primary Examiner*—Rabon Sergent
(74) *Attorney, Agent, or Firm*—Ogilvy Renault

(57) ABSTRACT

A combination of a semi-soluble methacrylic polymer and a sulfonated naphthalene condensation product, optionally with a semi-soluble or insoluble ethyl methacrylate polymer of high molecular weight, provides improved resistance to staining by acid colorants of fibrous polyamide substrate.

27 Claims, No Drawings

POLYAMIDE SUBSTRATE HAVING STAIN RESISTANCE, COMPOSITION AND METHOD

BACKGROUND OF THE INVENTION i) Field of the Invention

This invention relates to a fibrous polyamide substrate having durable resistance to staining by acid colorants and to a method of rendering a fibrous polyamide substrate durably resistant to staining by acid colorants.

ii) Description of Prior Art

Fibrous polyamide substrates, such as nylon carpeting are susceptible to staining by both naturally occurring and commercial acid colorants found in many common foods and beverages. The demand for reduced staining from such acid colorants has by and large been met by treatment with compositions comprising sulfonated naphthol or sulfonated phenolformaldehyde condensation products as disclosed for example in the following patents:

U.S. Pat. Nos. 4,501,591, 4,592,940, and 4,680,212, all of Blyth and Ucci; U.S. Pat. No. 4,780,099, Creshler, Malone and Zinnato; and U.S. Pat. No. 4,865,885, Herlant and Al; or by treatment with compositions comprising sulfonated novolak resins together with polymethacrylic acid as disclosed in U.S. Pat. No. 4,822,373 Olson, Chang and Muggli.

The use of polymers or copolymers of methacrylic acid of low weight average molecular weight and low number average molecular weight is described in U.S. Pat. No. 4,937,123 Chang, Olson and Muggli.

The initial stain resistance properties imparted to polyamide substrates, such as carpeting, that have been treated using the above mentioned compositions degenerates, significantly with each wet cleaning the substrate receives. Improved stain resistance after wet cleaning can be achieved by increasing the amount of the sulfonated hydroxy aromatic formaldehyde condensation products, in the stain resist product or by increasing the amount of stain-resist product initially applied to the substrate, however, this generally leads to discoloration caused by yellowing of the substrate initially and further discoloration upon exposure to light and/or oxides of nitrogen.

Stain resist products currently available in the market place are generally based on dihydroxydiphenyl sulfone and phenol sulfonic acid condensed with aldehyde in acid or alkaline media; or dihydroxy diphenyl sulfone and naphthalene sulfonic acid condensed with aldehyde in acid or alkaline media.

It is generally known that increasing the ratio of dihydroxydiphenyl sulfone to the phenol sulfonic acid or naphthalene sulfonic acid increases the stain resistance properties of the resin but causes a higher degree of yellowing or discoloration initially and further discoloration upon exposure to light and/or oxides of nitrogen.

It is also evident that when the ratio of phenol sulfonic acid or naphthalene sulfonic acid to dihydroxydiphenyl sulfone increases the result is lower stain-resist properties and less discoloration.

The addition of acrylic polymers and/or copolymers to the previously mentioned condensation products (novolak resin) as disclosed in U.S. Pat. No. 4,833,473 (Olson, Chang and Muggli) allows the use of a novolak resin in small quantities and larger quantities of the acrylic resin. With this combination of novolak resin and acrylic resin, major improvement in the light fastness or less discoloration is achieved due to the dramatically reduced amount of novolak resin in the product, which is adjusted to obtain a desired low level of discoloration while maintaining an acceptable level of durability to wash. The high level of initial stain resistance is supplied primarily by the acrylic polymer and/or copolymer and after wet cleaning stain resistance is supposedly maintained by the novolak resin, the acrylic polymer or copolymer having largely been removed during the wet cleaning process.

SUMMARY OF THE INVENTION

It is an object of this invention to provide fibrous polyamide substrates having durable resistance to staining by acid colorants.

It is further object of this invention to provide a method of rendering a fibrous polyamide substrate durably resistant to staining by acid colorants.

It is a particular object of this invention to provide such a substrate or method in which a treating solution is employed which contains a combination of a bleached, sulfonated naphthalene, aldehyde condensate, and semi soluble or insoluble acrylic resins of high weight average and high number average molecular weight, to produce high stain resistance and durability to wet cleaning process and also to provide an optimum light fastness and minimum discoloration of the polyamide substrate due to nitrogen oxides or light.

In accordance with one aspect of the invention there is provided a fibrous polyamide substrate having resistance to staining by acid colorants, comprising: a fibrous polyamide substrate having applied thereof: a) a semi-soluble methacrylic acid polymer, and b) a bleached, aldehyde condensate of a sulfonated naphthalene.

In accordance with another aspect of the invention there is provided an aqueous formulation for providing resistance to staining by acid colorants in fibrous amide substrates comprising in an aqueous vehicle, a combination of: a) semi-soluble methacrylic acid polymer, and b) a bleached, aldehyde condensate of a sulfonated naphthalene.

In accordance with still another aspect of the invention there is provided a method of imparting stain resistance to acid colorants, to a fibrous polyamide substrate comprising: contacting said fibrous polyamide substrate with: a) a semi-soluble methacrylic acid polymer, and b) a bleached, aldehyde condensate of a sulfonated naphthalene, in an aqueous vehicle.

DETAILED DESCRIPTION OF THE INVENTION

In accordance with the invention, it has been found that completely soluble acrylic and methacrylic homopolymers and copolymers do not have durability to wet cleaning, so that their stain resist effect diminishes with wet cleaning; whereas completely insoluble acrylic resins have very little stain resist effect on polyamide fibers.

The present invention employs one or more lower solubility acrylic resins, which resins are resistant to wet cleaning processes thereby providing durable stain resistance, together with a bleached, aldehyde condensate of a sulfonated naphthalene. This combination also provides initial stain resistance, prior to wet cleaning of the polyamide fibers as well as a soil release effect, and provides a substantial improvement in the light fastness.

In addition to the semi-soluble methacrylic acid polymer and the bleached, aldehyde condensate of a sulfonated naphthalene, there is preferably employed a semi-soluble or insoluble ethylmethacrylate polymer.

Suitably the semi-soluble or insoluble ethyl methacrylate polymer is a homopolymer of ethylmethacrylate or a copolymer of ethylmethacrylate and at least one comonomer, for example, ethylacrylate, methylacrylate, methylmethacrylate, methacrylic acid, butylmethacrylate, isobutyl methacrylate or 2-ethyl hexyl methacrylate.

The ethyl methylacrylate polymer suitably has a high weight average molecular weight of at least 100,000, typically 100,000 to 500,000, and preferably 100,000 to 250,000, and a high number average molecular weight of at least 25,000 to 100,000, preferably 30,000 to 70,000, more preferably 35,000 to 60,000.

The semi-soluble methacrylic acid polymer, is suitably a homopolymer of methacrylic acid or a copolymer of methacrylic acid and at least one comonomer, for example, ethylacrylate 2-ethylhexyl methacrylate, ethyl methacrylate, methylmethacrylate, butyl methacrylate or isobutyl methacrylate.

The methacrylic acid polymer suitably has a high weight average molecular weight of at least 100,000, typically 100,000 to 500,000, and preferably 150,000 to 250,000 preferably over 200,000; and a high number average molecular weight of at least 50,000, typically 50,000, to 100,000, and preferably 50,000 to 80,000, and more preferably 60,000 to 75,000.

The resin combination of the invention may optionally include a partially sulfonated resol resin.

The ethyl methacrylate polymer and the methacrylic acid polymer together with the bleached, aldehyde condensate of a sulfonated naphthalene and the optional partially sulfonated resol resin, preferably are applied to the polyamide fiber substrate in an aqueous vehicle in which the polymers and resin are mixed in water, such that the combination is applied to the substrate in a single bath typically at a pH of 1.5 to 10.

It is also within the scope of the invention to apply the components of the combination to the substrate from separate baths.

An aqueous formulation of the polymers, the naphthalene condensate and resol resin, if present, for treating a polyamide fiber substrate, typically contains an amount of the methacrylic acid polymer to deposit an amount on polyamide fiber substrate of Nylon 66 of at least 0.02%, preferably at least 0.1%, by weight and at least 0. 04%, preferably at least 0.2%, by weight, on Nylon 6. The ethylmethacrylate polymer is suitably present in the aqueous formulation in an amount to deposit 0% to 3%, by weight, based on the weight of substrate, on Nylon 66; and 0% to 4%, by weight, on Nylon 6. Suitable partially sulfonated resol resins are known and are described in my U.S. Pat. Nos. 5,457,259; 5,549,963; 5,736,468 and 5,756,407, the teachings of which are incorporated herein by reference. Suitable sulfonated naphthalene condensates are those described in U.S. Pat. Nos. 3,467,486 and 3,790,344, the teachings of which are incorporated herein by reference. The bleached, sulfonated naphthalene condensate is suitably present in the aqueous formulation in an amount to deposit at least 0.03%, by weight, preferably 0.03% to 2%, by weight, on Nylon 66, based on the weight of substrate; and at least 0.1%, preferably 0.1 to 4%, by weight on Nylon 6.

The optional resole resin is suitably employed in amounts to deposit the same range as the bleached, sulfonated naphthalene condensate of 0.1% to 4% by weight, of the substrate, on Nylon 6 and 0.03% to 2%, by weight, on Nylon 66.

In particular the bleached, sulfonated naphthalene condensate, is a condensate of a naphthalene sulfonic acid, for example, a mono-, di- or tri-sulfonic acid, such as naphthalene-2-mono-sulfonic acids; an aldehyde, especially formaldehyde and a dihydroxy-diphenyl sulfone, for example, 4,4'-dihydroxy-diphenylsulfone. The condensation may be in acid or alkaline media.

The condensate is bleached to reduce or remove colour which causes the yellowing of the nylon fibres, by techniques known in the art. By way of example the condensate may be bleached by addition of 0.1 to 4%, by weight, sodium or zinc formaldehyde sulfoxylate for a period of 20 to 90 minutes at a temperature below 100° C. This typically reduces colour by 20 to 80% and prevents further coloration. The bleaching or partial stripping of color is preferably carried out at a pH higher than 7 when sodium formaldehyde sulfoxylate is employed, and at a pH lower than 7 when zinc formaldehyde sulfoxylate is employed, and at a temperature of 50° C. or higher. The reference to bleaching, stripping or partially removing color herein refers to removal of the part of the color in the condensate which causes the yellowing of the fibers, bleaching, stripping or partial removal of color results in the condensate becoming lighter in color.

The degree of bleaching or stripping depends upon the naphthalene condensate and whether it is condensed at acid or alkaline media; and also depends on the stripping agent whether it is sodium or zinc, formaldehyde sulfoxylate, the bleaching or stripping conditions, for example, pH.

The time and the temperature are important factors and the percentage of stripping of the color varies, according to the stripping condition, between 20 to 80%.

After the bleaching or stripping, even if the color is still dark, it is observed that yellowing of the fibers does not occur.

The amounts of the naphthalene condensate and the optional resol resin deposited from the aqueous formulation on the polyamide fiber substrate is dependent on the process employed for the deposition, as it well understood by persons in the art, and thus persons in the art will well understand the concentrations required in the aqueous formulation, based on the application technique and method parameters employed.

The aqueous formulation is applied to the fibrous substrate by conventional procedures, for example, the substrate may be immersed in a bath of the aqueous formulation, or the formulation may be exhausted onto the substrate by foam system or spray or applied in one step with fluorochemical. Suitably, the treated substrate is rinsed with water and dried. The treated substrate retains the deposited polymer or polymers, the naphthalene condensate and the resol resin, if present.

In a preferred embodiment an anionic or non-ionic fluorochemical is also applied to the substrate. The fluorochemical can be applied from a single bath additionally containing the semi-soluble methacrylic acid polymer and the bleached condensate, as well as the optional ethylmethacrylate polymer and resole resin.

If separate baths are employed for the deposition of the different agents, the fluorochemical is conveniently included in the bath containing the bleached condensate.

DESCRIPTION OF PREFERRED EMBODIMENTS

Acrylic Copolymer A)

In a clean reactor vessel the following were added:

Mix #1

92.36 Parts by weight of water and 0.14 parts by weight of ammonium persulfate.

3 Parts of dodecyl benzene sulfonic acid (sodium salt at 30% solid). The solution was heated to 90° C. and maintained at this temperature at all time with continued agitation.

Mix #2

In a separate tank the following were added in parts by weight.

57.2 parts water, 29.6 parts methacrylic acid, 3 parts 2-ethyl hexyl methacrylate, and addition of ammonium persulfate to obtain the mole weight required.

Mix #2 was added slowly to Mix #1 while maintaining a temperature of 90° C. at all times; after the last addition the temperature was raised to 95° C., and the reaction was allowed to continue for 90 minutes, then the reaction mixture was cooled down to 30° C.

The above reaction resulted in an anionic hazy to milky solution with high viscosity and a solid content of 18 to 19%, by weight.

The resultant methacrylic acid copolymer had a weight average molecular weight of 210,000, and a number average molecular weight of 70,000, and is referred to in the Examples as acrylic copolymer A.

Acrylic Copolymer B)

To a clean reaction vessel equipped with a mechanical stirrer to produce efficient agitation the following was charged in parts by weight as Mix #1:

85.8 parts water and 2.2 parts ammonium persulfate;

3.25 parts dodecyl/benzenesulfonic acid, 30% neutralized sodium salt.

The resulting solution was heated to 80° C. and maintained at this temperature. In a separate tank the following were charged in parts by weight as Mix #2:

0.7 parts ethyl acrylate, 3.52 parts methyl methacrylate, 6.6 parts methacrylic acid, 45 parts water, 26.4 parts ethyl methacrylate, then finally another addition of ammonium persulfate was added to obtain the mole weight required.

Mix #2 was added slowly to Mix #1 while maintaining the temperature at 80° C. After the last addition the reaction was allowed to continue for 90 120 minutes at 80–90° C., and the reaction mixture was allowed to cool to 30° C. The reaction produced an anionic milky emulsion with approximately 25 to 26%, by weight, solid content. The resultant ethylmethacrylate copolymer had a weight average molecular weight of 110,000, and a number average molecular weight of 36000, and is referred to in the Examples as acrylic copolymer B.

The resol resin:

In my U.S. Pat. Nos. 5,457,259, 5,549,963 and 5,756,407, there is described the use of resol resin or resol resin and sulfonated naphthalene resin together in a combination with high molecular weight methacrylic acid copolymer.

In my U.S. Pat. No. 5,736,468, there is described the use of resol resin alone with a high molecular weight methacrylic acid copolymer.

The present invention provides a new art, taking the advantage of the use of bleached, sulfonated naphthalene resin and higher molecular weight semi soluble methacrylic acid polymer, preferably with a semi soluble to insoluble ethylmethacrylate polymer.

The naphthalene resin:

The manufacturing of naphthalene resin used in this invention is similar to that described in U.S. Pat. Nos. 3,467,486 and 3,790,344.

The naphthalene resin used in this invention has a preferred ratio of the dihydroxy diphenol sulfone to the naphthalene sulfonic acid between 25:75 and 40:60.

The dihydroxy diphenol sulfone and the naphthalene sulfonic acid are condensed with formaldehyde for several hours at 100 to 120° C. in acid media.

After the reaction, the color of the resin is semi bleached or partially removed by the method mentioned in my U.S. Pat. No. 5,457,259 by treating the naphthalene resin with 0.1% to 4%, by weight, of sodium formaldehyde sulfoxylate for 20 to 90 minutes at a temperature below 100° C., Zinc formaldehyde sulfoxylate can be employed in place of sodium formaldehyde sulfoxylate.

Test Methods

In the test procedures and examples described below all percentages are by weight unless otherwise indicated, the molecular weight (M.W.) is the weight average molecular weight, and the molecular weight (M.N.) is the number average molecular weight.

Initial Stain Resistance ("IS")

A 5"×5" sample of the substrate to be tested is placed on a flat, non-absorbent surface. A two inch ring is placed on the sample and 20 ml of staining solution is poured into the ring and worked into the substrate. The ring is removed and the sample is left undisturbed for 16 hours at ambient temperature. The staining solution is prepared by dissolving 0.6 grams of Acid Red Dye No.40 the sample is rinsed with cool tap water and dried.

The stain resistance of the sample is visually rated by assessing the amount of color remaining in the stained area by comparison with the unstained portion. The sample is rated on a scale from 1 to 8 wherein 8 is excellent stain resistance and 1 is poor stain resistance categorized as follows:

8=EXCELLENT STAIN RESISTANCE

7=GOOD STAIN RESISTANCE

6=POOR STAIN RESISTANCE

5=UNACCEPTABLE STAINING

4=UNACCEPTABLE STAINING

3=UNACCEPTABLE STAINING

2=UNACCEPTABLE STAINING

1=UNACCEPTABLE STAINING

After Wet Cleaning Stain Resistance ("W.S.")

The sample to be tested is first immersed in a detergent solution containing 15 grams of DUPONOL WAQE (Trade Mark of E.I. DuPont de Nemours for a surface active agent based on lauryl sulfate per liter of water at a pH of 10 and at 20° C. for 15 minutes. The sample is removed from the detergent solution and rinsed thoroughly with cool tap water and dried. The staining solution is then applied and evaluated as set out in the initial stain resistance procedure. The same evaluation scale is employed as for Initial Stain Resistance.

Initial Yellowing (Discoloration) Evaluation ("ID")

In the examples a graduated scale from 1 to 5 was used to evaluate yellowing where 5 represents no yellowing. 4 represents acceptable yellowing and 3 or less represents unacceptable yellowing.

Discoloration Upon Exposure to Light ("LD")

In the examples a graduated scale from 1 to 5 was used to evaluate discoloration exposure to light where 5 represents no discoloration. 4 represents acceptable discoloration and 3 or less represents unacceptable discoloration. Exposure to light was carried out according to ATCC test method 16E with an exposure time of 40 standard hours.

The acrylic copolymer A of this invention alone or in combination with acrylic copolymer B, and the naphthalene resin of this invention with the color removed, with or without the resol resin were tested against:

1. Polyacrylic polymer with molecular weight of 5,000
2. Polyacrylic polymer with molecular weight of 100,000
3. Methacrylic acid polymer of 10,000–15,000 MW
4. The above products were tested alone or in combination with the naphthalene resin to show the performance with or without the naphthalene resin and also tested with resol resin as a reference or comparison against the naphthalene resin as well as a novolak resin.

EXAMPLES

Example A

Test on Nylon 6

The treatment bath was adjusted to pH 2.2 with sulfamic acid and 3 g/l magnesium sulfate was added whenever the naphthalene or phenolic resins were present, to each bath. The amounts of the stainblockers used were as follows:

Example 1

14.0 g/L acrylic copolymer A (19 solids)

49/L acrylic copolymer B (25% solids)

Example 2

18 g/L acrylic copolymer A

Example 3

18 g/L methacrylic acid polymer of low molecular weight between 10,000 and 15,000 (25% solids)

Example 4

18 g/L polyacrylic acid polymer having a molecular weight of 5,000 (25% solids)

Example 5

18 g/L polyacrylic acid polymer having molecular weight of about 100,000 (25% solids)

Example 6

14 g/L acrylic copolymer A (19% solids)

4 g/L bleached, sulfonated naphthalene condensate (35% solids)

Example 7

14 g/L polyacrylic acid polymer of 5,000 MW (25% solids)

4 g/L bleached, sulfonated naphthalene condensate (35% solids)

Example 8

14 g/L polyacrylic acid polymer of 100,000 MW 4 g/L bleached, sulfonated naphthalene condensate (35% solids)

Example 9

14 g/L acrylic copolymer A (19% solids)

2 g/L bleached, sulfonated naphthalene condensate (35% solids)

2 g/L resol resin (35% solids)

Example 10

8 g/L bleached, sulfonated naphthalene condensate (35% solid)

Example 11

8 g/L resol resin (35% solids)

Example 12

8 g/L (novolak resin with 40% solids) condensed at 50:50 ratio of phenol sulfonic acid to dihydroxydiphenol sulfone

Example 13

8 g/l unbleached, sulfonated naphthalene condensate (35% solids) i.e., colour is not removed.

In each case, Nylon 6 substrate was immersed in the stain resist bath to a pickup of about 350%, then steamed for 3 minutes, followed by a light rinse; the substrate was dried for testing.

The results appear in Table #1:

TABLE #1

| Product | IS | WS | ID | LD |
|---|---|---|---|---|
| Example 1 | 7–8 | 6–7 | 5 | 5 |
| Example 2 | 7–8 | 6–7 | 5 | 5 |
| Example 3 | 6–7 | 4 | 5 | 5 |
| Example 4 | <3 | <1 | 5 | 5 |
| Example 5 | <3 | <1 | 5 | 5 |
| Example 6 | 8 | 7–8 | 4–5 | 4–5 |
| Example 7 | 6–7 | 5–6 | 4–5 | 4–5 |
| Example 8 | 6–7 | 5–6 | 4–5 | 4–5 |
| Example 9 | 8 | 7–8 | 4 | 4 |
| Example 10 | 7 | 6–7 | 4 | 4 |
| Example 11 | 6 | 5 | 3 | 3 |
| Example 12 | 5 | 4 | 3 | 2–3 |
| Example 13 | 7 | 6–7 | 3 | 2–3 |

Example B

Test on Nylon 66

The treatment bath was adjusted to pH 2 with sulfamic acid and 3 g/l magnesium sulfate was added whenever naphthalene or phenolic resin was presented.

Example 14

6 g/l acrylic copolymer A (19% solids)

2 g/L acrylic copolymer B (25% solids)

Example 15

8 g/L acrylic copolymer A (19% solids)

Example 16

8 g/L methacrylic acid copolymer with a molecular weight of 10,000 to 15,000 (25% solids)

Example 17

8 g/L polyacrylic acid polymer with a molecular weight of 5000 (25% solids)

Example 18

8 g/L polyacrylic acid polymer with a molecular weight of 100,000 (25% solids)

Example 19

6 g/L acrylic copolymer A (19% solids)

2 g/L bleached, sulfonated naphthalene condensate (35% solids)

Example 20

6 g/L polyacrylic acid polymer with MW 5,000 (25% solids)

2/L bleached, sulfonated naphthalene condensate (35% solids)

Example 21

6 g/L polyacrylic acid polymer with MW 100,000 (25% solids)

2 g/L bleached, sulfonated naphthalene condensate (35% solids)

Example 22

6 g/L acrylic copolymer A (19% solids)

1 g/L bleached, sulfonated naphthalene condensate (35% solid)

1 g/L resol resin (35% solids)

Example 23

5 g/L bleached, sulfonated naphthalene condensate (35% solid)s

Example 24

5 g/L resol resin (35% solids)

Example 25

5 g/L novolak resin (40% solids) same as the one used on Nylon 6 in Example 12

Example 26

5 g/l unbleached, sulfonated naphthalene condensate (35% solids).

The Nylon 66 substrate was immersed in the stain resist solution to a pick up of about 350% then steamed for approximately 3 minutes followed by a light rinse; the substrate was dried for testing.

The results appear in Table #2

TABLE #2

| Product | IS | WS | ID | LD |
|---|---|---|---|---|
| Example 14 | 7–8 | 6–7 | 5 | 5 |
| Example 15 | 7–8 | 6–7 | 5 | 5 |
| Example 16 | 7 | 5 | 5 | 5 |
| Example 17 | <4 | <2 | 5 | 5 |
| Example 18 | <4 | <2 | 5 | 5 |
| Example 19 | 8 | 7 | 4–5 | 4–5 |
| Example 20 | 6 | 5 | 4–5 | 4–5 |
| Example 21 | 6 | 5 | 4–5 | 4–5 |
| Example 22 | 8 | 6–7 | 4–0 | 4–0 |
| Example 23 | 7–8 | 6–7 | 5 | 4–5 |
| Example 24 | 6–7 | 5 | 4 | 3–4 |
| Example 25 | 6–7 | 5 | 3–4 | 3 |
| Example 26 | 7–8 | 6–7 | 3–4 | 3 |

The results in Table #1 and Table #2 for stain resist of Nylon 6 and Nylon 66, respectively, show the following:

1. Best results of stainblocking and wash durability with acrylic polymer, alone, were achieved with acrylic copolymer A, i.e., a high molecular weight methacrylic acid polymer, or in combination with acrylic copolymer B, i.e., a high molecular weight ethyl methacrylate copolymer.
2. The low molecular weight methacrylic acid copolymer is acceptable for initial staining but is easily removed by simple rinsing or washing.
3. The polyacrylic acid polymer whether low molecular weight or high molecular weight alone has very little effect as a stainblocker and no durability.
4. The bleached, sulfonated condensate of this invention having the adjusted solubility and colored removed from it after the reaction gives a better result than resol resin alone or novolak resin for the initial staining and more importantly it is demonstrated that the naphthalene condensate has the highest durability to wash.
5. The optimum results of initial staining resistant durability to wash and light fastness were obtained by the synergistic effect of the semi soluble or high molecular weight methacrylic acid polymer and the semi-soluble to insoluble ethylmethacrylate polymer, in the presence of a small amount of the bleached, sulfonated naphthalene condensate.

We claim:

1. A fibrous polyamide substrate having resistance to staining by acid colorants, comprising:

a fibrous polyamide substrate having applied thereto:

a) a methacrylic acid polymer having a weight average molecular weight of 100,000 to 500,000 and a number average molecular weight of 50,000 to 100,000; and b) a bleached, aldehyde condensate of naphathalene sulfonic acid, formaldehyde and a dihydroxydiphenyl sulfone;

said methacrylic acid polymer a) being resistant to wet cleaning processes applied to said substrate so as to provide durable stain resistance.

2. A substrate according to claim 1, wherein a) and b) are applied in combination.

3. A substrate according to claim 1, wherein said polymer a) has a weight average molecular weight of 150,000 to 250,000 and a number average molecular weight of 60,000 to 75,000.

4. A substrate according to claim 2, wherein said combination additionally includes c) an ethylmethacrylate polymer having a weight average molecular weight of 100,000 to 500,000 and a number average molecular weight of 25,000 to 100,000.

5. A substrate according to claim 4, wherein said polymer a) has a weight average molecular weight of 150,000 to 250,000 and a number average molecular weight of 60,000 to 75,000.

6. A substrate according to claim 5, wherein said polymer c) has a weight average molecular weight of 100,000 to 250,000 and a number average molecular weight of 30,000 to 70,000.

7. A substrate according to claim 4, wherein said polymer c) has a weight average molecular weight of 100,000 to 250,000 and a number average molecular weight of 30,000 to 70,000.

8. A substrate according to claim 1, wherein said combination additionally includes d) a partially sulfonated resol resin.

9. A substrate according to claim 1, wherein said methacrylic acid polymer is selected from the group consisting of methacrylic acid homopolymers and copolymers of methacrylic acid with at least one comonomer selected from ethylacrylate, 2-ethylhexylmethacrylate, ethylmethacrylate, methylmethacrylate, butylmethacrylate or isobutylmethacrylate.

10. A substrate according to claim 9, wherein said ethylmethacrylate polymer is selected from the group consisting of ethylmethacrylate homopolymers and copolymers of ethylmethacrylate and at least one comonomer selected from ethylacrylate, methylacrylate, methylmethacrylate, methacrylic acid, butylmethacrylate, isobutylmethacrylate or 3-ethylhexylmethacrylate.

11. A substrate according to claim 1, wherein the bleached condensate is formed by treating the condensate with 0.1 to 4%, by weight, based on the weight of condensate, sodium formaldehyde sulfoxylate at a pH higher than 7 or with zinc formaldehyde sulfoxylate at a pH lower than 7 for 20 to 90 minutes at a temperature of 50° C. or higher.

12. A substrate according to claim 1, additionally having applied thereto an anionic or non-ionic fluorochemical.

13. An aqueous formulation for providing resistance to staining by acid colorants in fibrous poly amide substrates comprising in an aqueous vehicle, a combination of a) a methacrylic acid polymer having a weight average molecular weight of 100,000 to 500,00 and a number average molecular weight of 50,000 to 100,000, and b) a bleached, aldehyde condensate of a naphthalene sulfonic acid, formaldehyde and a dihydroxy-diphenyl sulfone;

said methacrylic acid polymer a) being resistant to wet cleaning processes applied to said substrates so as to provide durable stain resistance.

14. A formulation according to claim 13, wherein said polymer a) has a weight average molecular weight of 150,000 to 250,000 and a number average molecular weight of 60,000 to 75,000.

15. A formulation according to claim 13, wherein said combination additionally includes c) an ethylmethacrylate polymer having a weight average molecular weight of 100,000 to 500,000 and a number average molecular weight of 25,000 to 100,000.

16. A formulation according to claim 15, wherein said aqueous vehicle additionally contains an anionic or non-ionic fluorochemical.

17. A formulation according to claim 13, wherein said combination additionally includes d) a partially sulfonated resol resin.

18. A formulation according to claim 13, wherein bleaching of the condensate is achieved by treating the condensate with 0.1 to 4%, by weight, based on the weight of condensate, sodium formaldehyde sulfoxylate at a pH higher than 7 or with zinc formaldehyde sulfoxylate at pH lower than 7 for 20 to 90 minutes at a temperature of 50° C. or higher.

19. The method of imparting resistance to staining by acid colorants, in fibrous polyamide substrate comprising:

contacting said fibrous polyamide substrate with:

a) a methacrylic acid polymer having a weight average molecular weight of 100,000 to 500,000 and a number average molecular weight of 50,000 to 100,000; and b) a bleached, aldehyde condensate of a naphthalene sulfonic acid, formaldehyde and a dihydroxy diphenyl sulfone in an aqueous vehicle; said methacrylic acid polymer a) being resistant to wet cleaning processes applied to said substrate so as to provide durable stain resistance.

20. A method according to claim 19, wherein said polymer a) has a weight average molecular weight of 150,000 to 250,000 and a number average molecular weight of 60,000 to 75,000.

21. A method according to claim 19, wherein said substrate is contacted with a) and b) in combination in a single aqueous bath.

22. A method according to claim 21, wherein said bath additionally contains an anionic or non-ionic fluorochemical.

23. A method according to claim 21, wherein said combination additionally includes c) an ethylmethacrylate polymer having a weight average molecular weight of 100,000 to 500,000 and a number average molecular weight of 25,000 to 100,000.

24. A method according to claim 23, wherein said combination additionally includes d) a partially sulfonated resol resin.

25. A method according to claim 19, wherein said substrate is contacted with a) and b) from separate aqueous baths.

26. A method according to claim 25, wherein the bath containing said bleached condensate additionally contains an anionic or non-ionic fluorochemical.

27. A method according to claim 19, wherein bleaching of the condensate is achieved by treating the condensate with 0.1 to 4%, by weight, based on the weight of condensate, sodium formaldehyde sulfoxylate at a pH higher than 7 or with zinc formaldehyde sulfoxylate at pH lower than 7 for 20 to 90 minutes at a temperature of 50° C. or higher.

* * * * *